United States Patent [19]

Smith et al.

[11] 4,250,628

[45] Feb. 17, 1981

[54] MICROWAVE FABRIC DRYER METHOD AND APPARATUS

[76] Inventors: Richard D. Smith, 2415 South Ct., Palto Alto, Calif. 94301; P. Michael Uthe, 15 Admiralty Pl., Redwood Shores, Calif. 94065

[21] Appl. No.: 50,821

[22] Filed: Jun. 21, 1979

[51] Int. Cl.[3] ..... F26B 3/34

[52] U.S. Cl. ..... 34/1; 34/69; 34/92; 34/75; 34/84

[58] Field of Search ..... 219/10.55 R, 10.55 M; 34/1, 84, 92, 48, 75, 133, 15, 18, 69

[56] References Cited

U.S. PATENT DOCUMENTS

| | | | |
|---|---|---|---|
| 2,528,476 | 10/1950 | Roos et al. | 34/75 |
| 3,266,166 | 8/1966 | Führing | 34/75 |
| 3,771,234 | 11/1973 | Foster et al. | 34/1 |
| 3,854,219 | 12/1974 | Staats | 34/48 |
| 4,015,341 | 4/1977 | McKinney et al. | 34/4 |
| 4,057,907 | 11/1977 | Rapino et al. | 34/92 |

*Primary Examiner*—Larry I. Schwartz
*Attorney, Agent, or Firm*—Limbach, Limbach & Sutton

[57] ABSTRACT

A dryer in which fabrics are dryed quickly and at low temperature by subjecting them to microwave energy in an atmosphere of reduced pressure. The microwave energy elevates the temperature of the water within the fabric to its boiling point, which is quite low because of the reduced pressure, and the water vapor which is released from the fabric is condensed external to the microwave field at the same reduced pressure. In one embodiment the dryer is formed as a clothes dryer wherein the drying chamber is a spherical metallic vacuum vessel; the microwave energy is supplied by a solid state microwave array within the drying chamber; water vapor is condensed by a spray condenser external to the drying chamber; and reduced pressure is obtained by a water jet exhauster, which functions in part as a condenser. Drying time is accelerated by warming the lower surface of the drying chamber with hot water, and a jet of air fluffs the fabric after drying.

25 Claims, 5 Drawing Figures

MICROWAVE FABRIC DRYER METHOD AND APPARATUS

DESCRIPTION

1. Technical Field

This invention relates to machines for drying wet fabrics utilizing microwave energy in an atmosphere of reduced pressure. The microwave energy elevates the temperature of the water within the fabric to the boiling point, which is quite low because of the reduced pressure, and the water vapor which is released from the fabric is removed by condensation external to the microwave field.

2. Background Art

Clothes dryers in use today dry clothes by blowing hot air through them. Fabrics are relatively porous and if the clothes are tumbled, the hot air can be made to contact most of the surface. The hot air performs two functions; heat from the air vaporizes the water and the heated air, having a large capacity to hold water vapor, transports the water vapor from the chamber.

When clothes are first placed in the dryer after leaving the washing machine they are quite wet. Approximately 40% of their weight is moisture. Initially the drying occurs at relatively low temperatures as the heated air easily evaporates large amounts of moisture from the wet clothes. After the majority of water has vaporized, the heated air begins to heat the fabric itself. Some of the water deep within the fabric is vaporized by heat conducted to it by this fabric material. The tighter the weave and the thicker the cloth, the more that the heat is transferred into the moisture in the cloth by conduction. To limit heat damage to the fabric most dryers have a temperature control switch on the exit airstream limiting its temperature to 140° F. When that temperature is reached the temperature of the incoming airstream is reduced sufficiently to maintain the exit air temperature below 140° F. This tends to increase the drying time over that which would be theoretically possible.

A normal load of wet clothes from a home washer weighs approximately 15 pounds. Most home dryers dry this load in perhaps 30 minutes. Large loads of difficult drying fabrics, such as Turkish towels, may take an hour.

Many of the personal-use fabrics are sensitive to heat and cannot be dried in a conventional home dryer. Wool, for example, may be washed safely in cold water, but must be air dried. If wool is exposed to the temperature of a conventional dryer, it will shrink and be rendered useless. As a result, most delicate fabrics are dry cleaned, meaning that they are immersed in hydrocarbon solutions to remove dirt and subsequently dried at a low temperature. Dry cleaning is expensive and the hydrocarbon vapors vented into the atmosphere pollute the air.

The efficiency of a conventional dryer is approximately 50%. Inefficiency results from the inability to transfer heat from the air to the water to vaporize it, the necessity to heat the clothes themselves and the walls of the dryer during the latter stages of drying, and the necessity to have a hot airstream issue from the dryer to transport the water vapor out of the drying chamber.

Microwave heating is well known through the home microwave oven. These ovens cook food in a fraction of the time of a conventional oven by heating the food throughout rather than from its surface. Microwaves in the 915 MHz and 2450 MHz frequency ranges heat polar molecules throughout a substance. The polar molecules align themselves with the electromagnetic field and when the field is rapidly reversed, 915,000,000 times a second for example, the friction on the polar molecule twisting back and forth causes heating of the molecule. Water is a highly polar molecule as are certain fats. Molecules that are non-polar are little affected. Hence the cooking of the food results from heat generated from the polar molecules throughout the food itself. The convenience of the shortened cooking time is well established by the large market for microwave ovens.

Microwave drying is well known in the patent art. It has been applied to lumber, foods, polymers, clothes, seeds and other substances. Microwave dryers take advantage of the capability of the microwaves to reach into the depths of a material and selectively heat the water vapor while leaving the material generally unaffected. As anticipated, those materials most difficult to dry show the most drastic reductions in drying times.

Foster et al., U.S. Pat. No. 3,771,234, teaches the drying of polymers by microwave energy while they are being transported through the plant in a pneumatic transport pipe. Drying to a moisture level of 0.5% occurred in three seconds. The drying temperature of one polymer, polyisobutylene, was reduced from 437° F. to 185° F., resulting in improved physical properties and appearance of the material.

Staats, U.S. Pat. No. 3,854,219, teaches the drying of clothes in a conventional type of clothes dryer by using microwave energy to evaporate the moisture and a preheated airstream to remove the moisture from the chamber. Staats anticipated a considerable improvement in performance over a conventional dryer, but provides no specific information. Undeniably Staats' clothes dryer will provide superior performance over a conventional dryer, but drying speed will be limited by the use of preheated air to transport water vapor from the chamber. The full potential of microwave heating to reduce drying time and reduce drying temperature will not be exploited.

For example, if microwave power were not limiting and it was desired to reduce the drying time of a load of clothes from thirty minutes to ten minutes while simultaneously reducing the drying temperature from 140° F. to 100° F., the airflow through Staats' dryer must be increased ten times over that envisioned by Staats. Such airflow rates are not practical for clothes dryers. Consequently, Staats does not teach methods or apparatus for making best use of microwave energy for rapid drying and low-temperature drying, but rather teaches the application of magnetron microwave power to a conventional dryer to receive whatever incremental gains in performance result.

Microwave drying of fabrics can be accomplished quickly by the application of large amounts of microwave power if the water vapor can be transported away from the material. Because the microwaves selectively heat the water molecules and do not significantly heat most of the materials to be dryed, increasing the power levels increases the rate of vaporization without effecting the material. Only the cost of the microwave power generator to the convertible electric power capacity limit the power level.

One method to remove moisture quickly and dry material at low temperature is to evacuate and maintain the drying chamber at an absolute pressure of 1.5 inches of mercury or below. At that pressure water boils at 92° F. and the vapor will be transported out of the material and from the chamber as fast as it is generated. It is only essential that the material being dryed is sufficiently porous to allow the vapor to reach its surface without exerting sufficient force to damage the material. Popcorn is a good example where water vaporized within a material is unable to escape rapidly and material fracturing occurs.

McKinney et al., U.S. Pat. No. 4,015,341, teaches the drying of seeds with microwave energy under reduced pressure. The objective of this method is to dry seeds quickly yet minimize the temperature in the seed during drying to improve its germination capability when later planted. McKinney dried the seed at an absolute pressure of 2.4 in. Hg, at which pressure water boils at 107° F. He found that the temperature within the seed was 10° F. to 20° F. over the boiling temeprature of the water.

McKinney teaches the generation of microwave power external to the vacuum vessel and the transmission of that power into the chamber by means of waveguides. McKinney further teaches the use of a cooled surface within the vacuum chamber to condense the water vapor and maintain the vacuum once the chamber is evacuated to the working pressure.

Microwave drying is inherently efficient because the microwave energy is absorbed directly by the water molecules. However, according to the known art, magnetron type tubes are used to generate power for microwave ovens and industrial microwave dryers. The use of magnetron tubes was taught by Staats, U.S. Pat. No. 3,854,219, for application to a clothes dryer. Magnetron tubes for microwave heating have an efficiency of approximately 50% in converting input electrical power to microwave power. Most microwave drying methods attempt to use the waste heat in some way to speed drying, but its use is only partially effective compared to the microwave energy itself.

The development of radar during World War II provided the stimulus for a major development in tubes to generate microwave energy. The magnetron tube which is used to generate energy for microwave ovens today is a descendant of this earlier work. In microwave ovens, the tubes are generally rated at 1.5 kW. The tubes need a magnetic field in order to operate; this field is supplied by either a permanent magnet or an electromagnet. The combination of a magnetron tube and its magnet for a microwave oven weighs approximately 40 pounds.

Household dryers today are rated at perhaps 5.5 kW; a truly rapid household microwave dryer would be rated at 10 kW. Use of magnetron tubes for a rapid household dryer at this rating would require that the power system alone would weigh 400 lbs., an intolerable weight for a household appliance.

Solid state technology has been developing rapidly over the past ten years. The control systems on many pieces of equipment now use solid state technology as do computers. Compared to tubes, solid state devices are smaller, more efficient, and more reliable. Most of the applications to date have been in control applications because of the limited capability of the solid state devices to handle higher power levels.

Recently, solid state devices of a particular design have been constructed to generate microwave energy directly. These devices have been applied to special communication applications, but advancing state of the art now makes versions of this technology practical for large volume applications, such as the microwave fabric dryer. Like other solid state devices, they are more efficient, smaller and more reliable than the tubes they replace. Their method of manufacture is a tightly held trade secret.

DISCLOSURE OF THE INVENTION

The principal object of the present invention is to provide a fabric dryer that dries fabric in one-third the time, or less, of current dryers and dries at a temperature low enough to protect heat sensitive fabrics, wool for example. A further objective of the invention is to increase the efficiency of an electric dryer from 50% to 70% or better.

The present invention dries fabric quickly and at a low temperature by applying large amounts of microwave power to the wet fabric while it is under reduced pressure. The water boils at a low temperature (92° F. for example), protecting the fabric, and is condensed at the same low pressure by a direct contact condenser. Since the water transport and condensation function are not limiting, the rate of drying is determined by the amount of power available at the site and the capital cost of the microwave device to utilize that electrical power. In the home, the power limit usually corresponds to the electrical service for an electric stove, approximately 12 kW. Using 12 kW of input power with a 10 kW solid state microwave array (new to the state of the art) drying times of 11 minutes are achieved for a home dryer with a 15 pound load of clothes. The partial vacuum needed for the low-temperature water vaporization is supplied by a water jet exhauster, an inexpensive rugged device.

In addition to its application as a household dryer, the subject invention could be used as a process dryer for commercial cleaners. Since wool and other fine fabrics may now be dried without harm, washing and microwave drying would replace dry cleaning for many fabrics. Dry cleaning processes are expensive and emit hydrocarbon fumes to the atmosphere.

Small microwave dryers could be used by apartment dwellers. These units could be placed in motels as convenience dryers for those who had a light hand wash.

DESCRIPTION OF THE PREFERRED EMBODIMENT

Figure 1:
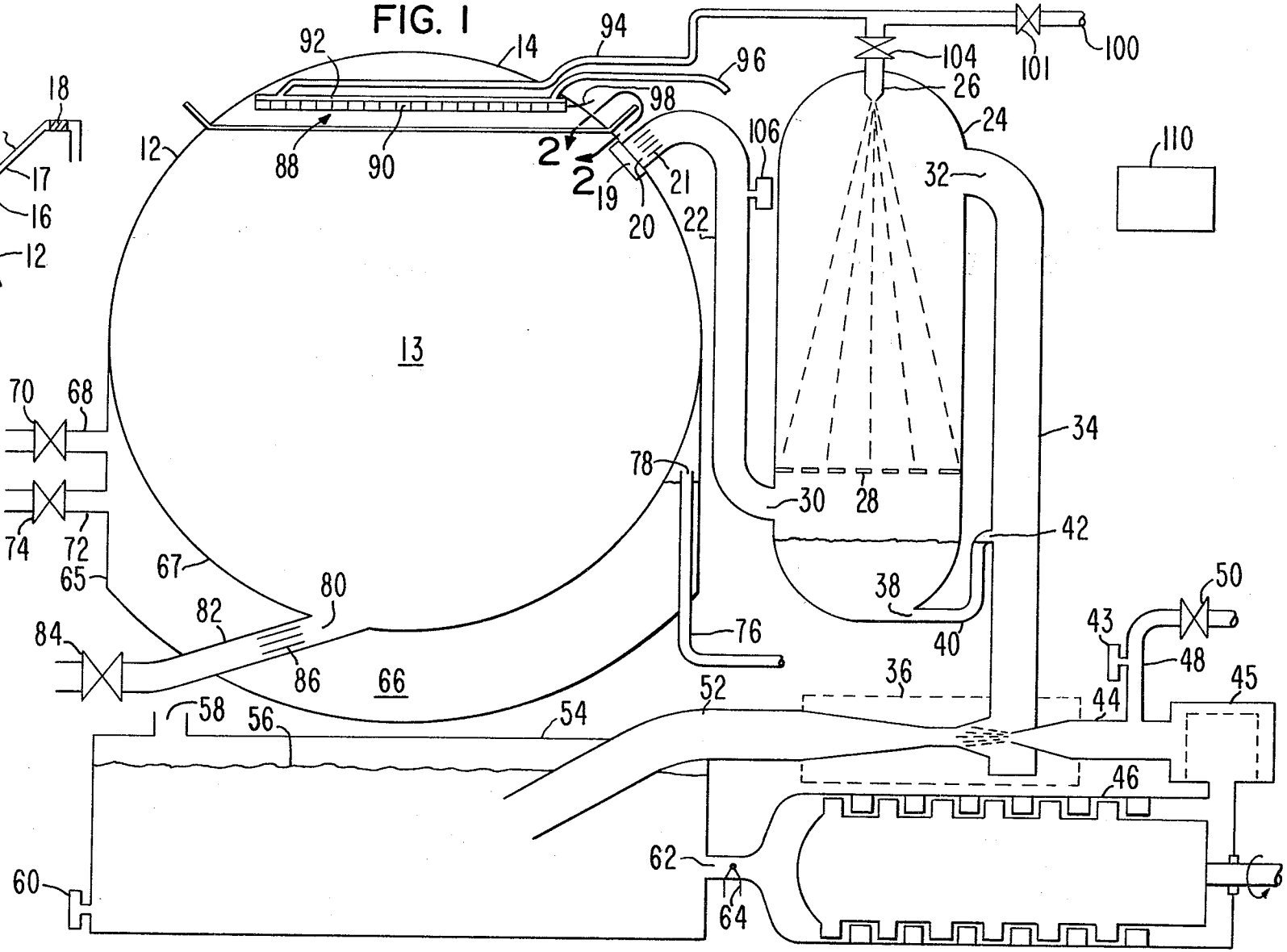
FIG. 1 is a diagramatical elevational, sectional view of the subject invention.
Figure 2:
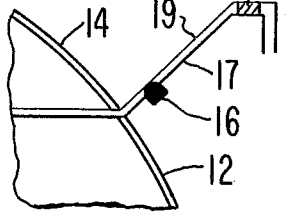
FIG. 2 is an enlarged sketch of a portion of the structure of FIG. 1 illustrating the interface between the door and the chamber showing the vacuum seal and radiation seal.

With reference to FIG. 1, the wet fabric to be dried is placed in a spherical drying chamber 12 by means of a door 14 which is closed and locked after the fabric has been placed in the chamber. The spherical chamber 12 is made of metal, such as mild steel. As shown in FIG. 2, between the door 14 and the chamber 12 a pressure seal 16 prevents air from the atmosphere from leaking into the drying chamber. The pressure seal 16 is made of material that reflects microwave radiation and prevents microwave radiation leakage from the chamber. A redundant microwave seal 18 is provided downstream of the pressure seal 16 to assure that no microwave energy leaves the interior of the drying chamber. The distance between the lip 17 of the drying chamber and the lip 19 of the door is less than one-quarter wavelength to provide a natural barrier to the escape of radiation.

The arrangement of the microwave power array and its geometric relationship to the spherical drying chamber may take on various configurations depending upon such practical considerations as utility service convenience, cost, service-ability, and radiation antenna efficiency.

These flexibilities of design are possible because the microwave dryer is not a communication device requiring phase focusing either in a predetermined plane or at a geometrical point. In addition, resonance of the discrete microwave devices will not be highly dependent upon any microwave resonance characteristics of the spherical cavity. What is desired is a highly scattered microwave beam that can intersect wet fabric irrespective of the position of the fabric within the drying chamber.

However, since it is desirable to minimize RF energy absorption in the walls of the drying chamber, the first approximation optimum distance, $\gamma$, from the geometric planar center of the microwave power source array and the bottom center point of the sphere should be as described by the following formula:

$$\gamma = N\lambda/4$$

with $N = 1,3,5 \ldots N$ being an odd integer
where $\lambda = C/f$
with $C$ = velocity of light in the medium
$f$ = microwave excitation frequency For a 915 MHz microwave frequency and C equal to $3 \times 10^{10}$ cm/sec.

$$\gamma \simeq N \cdot 8.2 \text{ cm}$$

for $N = 5$, $\gamma \simeq 41.0$ cm (16.1 in.)
for $N = 7$, $\gamma \simeq 57.4$ cm (22.6 in.)

These are practical interior dimensions for usable fabric dryers.

With no fabric load, the impedance reflected into the center of the power source array is a maximum and therefore the power output with a constant source voltage will be a minimum.

When wet fabric is inserted into the drying chamber and then falls by gravity to the bottom of the chamber, the subsequent activation of the microwave power source will result in a reduction of wall reflections because a portion of the RF wave will be absorbed by water molecules.

This reduction in wall reflections produces a reduction in load impedance as seen by the microwave source and will permit increased radiative power output. This is a desired characteristic of this invention.

The absorption of microwave energy by the polar water molecules can be characterized as a pure microwave resistance and therefore will have little effect on the drive frequency of the solid state array unless the drying chamber has been mistakenly designed to be a resonant cavity. The use of a spherical shape for the microwave chamber precludes this possibility.

Since the microwave dryer operates on the principal of real microwave energy absorption, high Q tuning of the drying chamber may result in the defeat of the practical purpose of this invention.

Q = ratio of stored energy per cycle of RF to input power per RF cycle.

Therefore, for the purposes of this invention, a high voltage-standing-wave-ratio (VSWR) under dry and empty chamber conditions is desired. This is contrary to normal communication systems design practice.

Although not a part of this invention, the technique of matching the microwave power transistor array to the drying chamber will require specialized design techniques, for in this instance, low VSWR's and high transmission efficiencies are desired.

The back reflected wave from the opposite wall (bottom surface) of the spherical drying chamber will be used to sense the degree of dryness of the fabric being dried and to provide the activation signal to turn-off the microwave source at the completion of the drying cycle.

Instead of using the microwave power transistors themselves as detectors of fabric dryness, it may be desirable under some conditions to incorporate separate microwave detector transistors into the solid state microwave array. Although this would provide an improved means of control over the fabric drying process, additional manufacturing costs would also be incurred.

An opening 20 in the drying chamber 12 is connected to a vacuum transfer line 22 which communicates with a spray condenser 24. A radiation trap 21 in the line 22 prevents the escape of radiation. The spray condenser 24 is comprised of a chamber which contains at the top a water spray nozzle 26 and lower down a vapor distribution plate 28. The vapor transfer pipe 22 enters the spray chamber 24 through an opening 30 below the distribution plate 28, but above the bottom of the spray condenser 24. A second opening 32 which is near the top of the spray condenser 24 communicates the interior of spray condenser 24 with a water jet exhauster 36 through a second vacuum transfer line 34.

A third opening 38 at the bottom of the spray condenser 24 is attached to a condenser water drain line 40 which communicates through an opening 42 in the vacuum transfer line 34. The opening 42 in the vacuum tranfer line 34 is located above the opening 38 in the spray condenser 24 such that a column of water exists in the condenser water drain line 40 to prevent air and water vapor flow through the condenser water drain line 40. The opening 42 into the vacuum transfer line 34 is below the opening 30 connecting vacuum transfer line 22 into the spray condenser 24.

Water under pressure is supplied to the water jet exhauster 36 by a water pressure line 44 which communicates with a water pump 46. A water drain line 48 communicates with the pressure line 44. A valve 50 is located in the water drain line 48.

A water jet exhaust line 52 communicates with the water jet exhauster 36 and a water reservoir tank 54. The water reservoir tank has a vent 58 to the atmosphere and a level control switch 60. The water level 56 in the water reservoir tank 54 is maintained below the water jet exhauster 36. An opening 62 in the water reservoir tank 54 communicates with the inlet to the water pump 46. A temperature senser 64 measures the temperature of the water entering the water pump 46.

A surrounding water jacket 65 is attached to the lower portion of the vacuum drying chamber 12 providing a water jacket chamber 66 therearound such that water within the water jacket chamber 66 is in direct contact with the exterior surface 67 on the lower portion of the drying chamber 12. A hot water inlet line 68 containing a valve 70 is in communication with the water jacket chamber 66 and a cold water inlet line 72 containing a valve 74 is likewise in communication with the water jacket chamber 66. A water drain line 76 is also in communication with the water jacket chamber 66. The inlet 78 to the water drain line 76 is located near the uppermost portion of the water jacket chamber 66.

An opening 80 located in the bottom of the drying chamber 12 is connected to a fluff jet pipe 82 which contains a valve 84 which communicates with the atmosphere. The fluff jet pipe 82 is located such that the angle between the access of the pipe and the surface of the chamber is greater than zero degrees, but less than 60 degrees. A radiation trap 86 is located in the fluff jet pipe 82 to prevent the escape of microwave energy from the drying chamber 12.

A solid state microwave array 88 is located within the drying chamber 12 and positioned so that the microwave radiation leaving its surface is generally directed at the fabric to be dried. The solid statemicrowave array 88 is composed of solid state devices 90 mounted on a heat sink 92 which is cooled by cold water transmitted by a cold water cooling line 94. The heated water is removed from the heat sink 92 by means of a drain line 96. Electrical power, suitably modified, is transmitted to the solid state microwave array 88 by an electrical cable 98.

A cold water inlet pipe 100 communicates with a shut-off valve 101 and subsequently with spray condenser water valve 104 and with the cold water line 94 to the solid state microwave array 88.

After the web fabric to be dried is placed in the drying chamber 12 and the door 14 has been closed and locked, the water pump 46 is actuated and begins circulating water through the water jet exhauster 36. The water exiting the water jet exhauster 36 is returned to the water reservoir 54. At the start, the water is assumed to be at ambient temperature. Valve 50 in the water jet line 48 is closed.

The water jet exhauster 36 draws the residual air from the dryer chamber 12 through the vacuum transfer pipe 22, the spray condenser 24 and the vacuum transfer line 54. Concurrent with the activation of the water pump 46, the hot water valve 70 to the water jacket chamber 66 is open allowing hot water with a maximum temperature of 140° F. to fill the water jacket chamber 66. The water at ambient temperature in the chamber at the start of the process is drained from the chamber through drain pipe 76. The design of the water jacket chamber 66 is arranged so that incoming water largely displaces the water in the chamber. The valve 70 is closed after the chamber 66 is largely filled with hot water. A solid state timer 110 allows the valve 70 to stay open for a preset time. The heat from the warm water is easily transferred into the metal wall of the drying chamber 12 thereby warming it. The warm wall in turn begins warming the wet fabrics in the dryer.

When the pressure in the drying chamber has reached approximately 10 inches of mercury absolute as measured by a chamber pressure senser 106, the solid state microwave array 88 is turned on and the microwave energy begins to heat the water molecules in the fabric. The water in the fabric will begin to heat up but will not vaporize immediately because the pressure is too high. Shortly the pressure in the chamber will reach 1.5 inches of mercury absolute and any water in the fabric that had reached 92° F. or above will immediately begin to vaporize. Any water that had reached a temperature in excess of 92° F. will be cooled by the vaporization until its temperature has been lowered to 92° F. The time at which the microwave 88 will be turned on will be adjusted to insure that the temperature of the wet clothes does not exceed 92° F.

At the time that an absolute pressure of 1.5 in. Hg is achieved, the speed of the pump 46 is reduced to maintain the pressure at 1.5 in. Hg or slightly below. The water pump 46 and water jet exhauster 36 are oversized to remove the air from the drying chamber 12 quickly and need not operate at full speed once the majority of the residual air has been removed.

After an absolute pressure of 1.5 inches of mercury has been achieved in the drying chamber, the water in the clothes heated by both microwave energy and by heat conducted through the wall of the drying chamber 12 will vaporize at 92° F. The microwave energy will be most heavily absorbed by the wettest portion of the fabric and will tend to vaporize more water in the wetter portions, causing a more uniform drying action.

The microwave energy will penetrate throughout the wet clothes causing the water to vaporize, even that water deep within the fabric. Because the fabric is porous, even this vapor evolved deep within the fabric will have little problem in finding its way out into the empty space of the drying chamber 12.

Heat will be conducted from the warmed wall of the drying chamber 12 to the wet surface of the fabric resting on the wall. Heat transfer by conduction will also occur to the water held in the fabric, and vaporization at 92° F. will likewise occur. The natural wicking action of the cloth will cause water from the interior of the fabric to flow toward to the surface as water from the surface is vaporized. In addition, if any vapor is superheated over the equilibrium temperature of 92° F., that super-heat will be conducted to the liquid water as the vapor passes through the fabric on its way to the chamber. During the early stages of drying, the heat transfer coefficient between the warm wall and the wet clothes at an absolute pressure of approximately 1.5 in. Hg is approximately 110 $BTU/FT^2$-Hr-F.

The vapor initially evolved from the fabric will pass through the vapor transfer line 22, the spray condenser chamber 24 and the vapor transfer line 33 into the water jet exhauster 36. The vapor will be condensed by contact with the cooler water jet in the vapor jet condenser. As vapor is condensed in the water jet exhauster, the water in the reservoir 54 will be heated above the ambient temperature. The water jet exhauster 36 is designed to pump non-condensible gases rather than to act as a condenser. The surface area of the water jet is limited in area and hence its ability to condense water vapor is limited.

As the vapor evolution from the drying chamber 12 increases beyond the capability of the water jet exhauster 36 (as sensed by increasing pressure by the chamber pressure sensor 106), the water valve 104 opens admitting cold water to the spray nozzle 26 of the spray condenser 24. The spray nozzle converts the cold water into a finely divided mist to expose a large surface area of the incoming cold water to the vapor flow. The vapor passes through the vapor distribution plate 28 and flows upward countercurrent to the downward flowing water spray. The cold water spray enters at a temperature ranging from 50° F. to 60° F. and is heated to perhaps 85° F. as the water vapor condenses on the surface of the droplets. The large surface area assures efficient heat transfer. Any vapor not condensed in the spray chamber 24 passes into the water jet exhauster 36 where it is subsequently condensed. In large measure, however, the water jet exhauster will continue to remove residual air, any air that leaks into the system while in operation or any air that is deliberately admitted to the system while in operation.

The water leaving the spray nozzle 26 passes through the distributor plate 28 and collects in the bottom of the spray condenser 24. The water flows through the condenser water drain line 40 into the vapor transfer tube 54 and into the water jet exhauster 36 where it is pumped into the water reservoir 54 by the oversized water jet exhauster 36.

The flow of water from the spray condenser gradually increases the water level in the water reservoir 54. The water level switch 60 senses when this level has reached the upper limit and commands the control system to open the valve 50 on the water drain line 48. When the lower limit has been obtained, the valve is caused to close.

Returning to consideration of the wet fabric in the chamber, after approximately 30–50% of the moisture has been evaporated, the wicking action of continuously bringing new moisture to the fabric adjacent to the warm wall becomes less effective. To turn the fabric in the drying chamber over and expose new wetter surface to the warmed wall of the drying chamber 12, the fluff valve 84 is opened briefly admitting a jet of air into the drying chamber and directed in such a way that it causes the fabric to flip over in the drying chamber.

The brief introduction of air will be sufficient to increase the chamber pressure above 1.5 in. of Hg. The water pump 46 is caused to operate at full speed to remove the air introduced by the fluff jet and restore the normal vaporization temperature and condensing action in the dryer. The rearrangement of the fabric in the dryer also opens the folds in the fabric and fluffs the clothes. Once the operating pressure 1.5 in. Hg absolute has been reestablished, the pump motor is slowed to half speed again. The procedure may be repeated several times in a drying cycle.

Once the majority of water has been removed from the fabric, the heated wall becomes ineffective in transferring heat to the water remaining in the fabric and eventually 100% of the energy is supplied by microwave energy. The fabric will be dried to a moisture content in the range of 5% to 10% at which time it feels dry to the touch.

Termination of drying will be sensed by electrical feedback from the solid state microwave array, indicating that the radiation from the array is being absorbed at a reduced rate in the drying chamber.

Upon direction of the shut down signal, the solid state control 110 turns off the solid state microwave array 88, opens the fluff valve 44, opens the cold water valve 74 in the water jacket chamber 66 and closes the water valve into the spray chamber 24. The air rushes into the drying chamber 12 through the fluff jet air pipe 82 and fluffs the fabric thoroughly. The air subsequently fills the drying chamber 22, spray condenser 24 and the vapor transfer lines 22 and 34. When atmospheric pressure has been reached in the system, the water pump is turned off.

The cold water entering the water jacket chamber 66 cools the lower surface of the drying chamber 12 preventing heat soak into into permanent press fabrics which would cause creases in the fabric should it not be removed promptly from the dryer.

Finally the door is opened and the fabrics are removed. The dryer is ready to start the next cycle immediately.

The solid state microwave array 88 is mounted on the door 14, but may be mounted anywhere in the upper portion of the drying chamber 12 whereby the microwave may be generally directed at the fabric to be dried. The solid state microwave array 88 is composed of one or more solid state devices mounted on a heat sink which is cooled by water as shown in FIG. 1, but may be cooled by air. The power line 98 to the microwave array passes through an interlock (not shown) which prevents electrical power from being connected to the microwave array if the door 14 is not closed and latched.

The solid state microwave array radiates microwave energy directly from the surface of the solid state devices and operates typically at either 915 MHz or 2450 MHz, two frequencies approved by the FCC for microwave heating devices or other frequencies in the range of 500 MHz to 50,000 MHz, depending upon authorization by the FCC. Also, it is not important for purposes of this invention that the microwave power signal be broadbanded in frequency. The requirements of this invention are not technically related to the requirements normally encountered in microwave communications. Neither frequency bandwidths nor frequency stability are important parameters in microwave fabric drying as dislosed herein.

The microwave array is mounted entirely within the metal cavity 13 of the drying chamber and supplied with 220 V single phase power to the power cable 98 penetrating the wall. Current state of the art microwave heating devices mount the microwave source external to the chamber and transmit the microwave energy into the chamber by means of a waveguide. Placing the microwave source within the cavity eliminates waveguide losses and reduces the risk of microwave leakage from the external power equipment and waveguide.

The microwave energy released into the cavity 13 will either be absorbed by water directly on its first pass through the cavity or be reflected from the metal wall successively until it either intersects water molecules and is absorbed or its energy is expended in wall losses in cumulative contacts with the walls. The vacuum drying cavity is designed so as to minimize microwave wall absorption when operated empty. The internal dimensions of the cavity will directly depend upon the frequency of radiation, and these dimensions can be computed through use of accepted and well-known transmission line equations. Perfect or highly optimized transmission line (traveling wave) reflectivities are not critically important in the design of the microwave fabric dryer.

When the available water in the fabrics in the cavity 13 is reduced near the end of the drying cycle, the microwave array will sense the loss of absorption and direct a portion of its output internally into the array itself. This current is sensed and provides the shut down signal to indicate the end of the drying cycle.

A temperature sensor 64 in the inlet of the water pump 46 measures the temperature of the water entering the pump. If that temperature exceeds 85° F. it lights a warning light and commands the water valve 104 to the spray condenser 24 to open from the initiation of the cycle. If the temperature of the water exceeds 88° F. it signals the control system to shut down the microwave power until the temperature has dropped below 85° F. In a particular application, if the 85° F. temperature level is exceeded frequently, the cold water flow rate through the nozzle 26 is increased to reduce the water temperature in the reservoir.

Fabric has a certain amount of lint that inevitably becomes airborne during most drying operations. Conventional dryers which blow air through the fabric encourage lint generation. In the microwave fabric dryer little lint generation is anticipated during most of the drying cycle except during the brief applications of the fluff jet 82 to turn the clothes. In addition, the low absolute pressures existing within the drying chamber 12 will not provide sufficient aerodynamic support to allow the material to remain airborne after the jet has subsided. Nevertheless a lint filter 19 is provided over the opening 20 into the transfer pipe 22 to prevent most of the lint that does fly from entering the vacuum system.

During the final atmospheric pressure return with the fluff jet, the major lint generation will occur and the major potential for lint induction into the vacuum system will occur. This period is brief, however, compared to conventional dryers.

Inevitably lint will find its way into the circulating water of the vacuum system. To prevent build up of lint in the system a lint filter 45 is included in the water flow circuit. The solid state control will sense excessive pump output pressure through a sensor 43 and signal a warning light to clean the filter.

The water jet exhauster—water pump combination has several advantages over mechanical vacuum pumps for the dryer application. The water jet exhauster is capable of rapid pump down from atmosphere because of its inherently high flow rate at the higher subatmospheric pressures. Further, the system is not sensitive to lint or dirt or to condensed water vapor. Finally, it provides a condensing function in addition to its vacuum producing function.

As mentioned earlier, conventional electric dryers have an efficiency of 50% based upon the incoming electrical energy. The subject invention has a substantially higher efficiency because of the absence of the hot air stream issuing from the dryer and the high efficiency of the solid state microwave array 88. The overall efficiency of the subject invention is approximately 70% using solid state devices in the microwave array with a conversion efficiency of 90%. Only 4% of the total power is used for the water pump to provide the vacuum. If the water jacket chamber is eliminated from the subject invention and 100% of the heat of drying is supplied by the solid state microwave array 88, the efficiency would be 86%.

The invention illustrated in FIG. 1 and previously described may be simplified to reduce its initial cost, but with the disadvantage of increasing water consumption, increasing drying time or both. For many applications these simplified alternate embodiments may be preferable.

Figure 3:
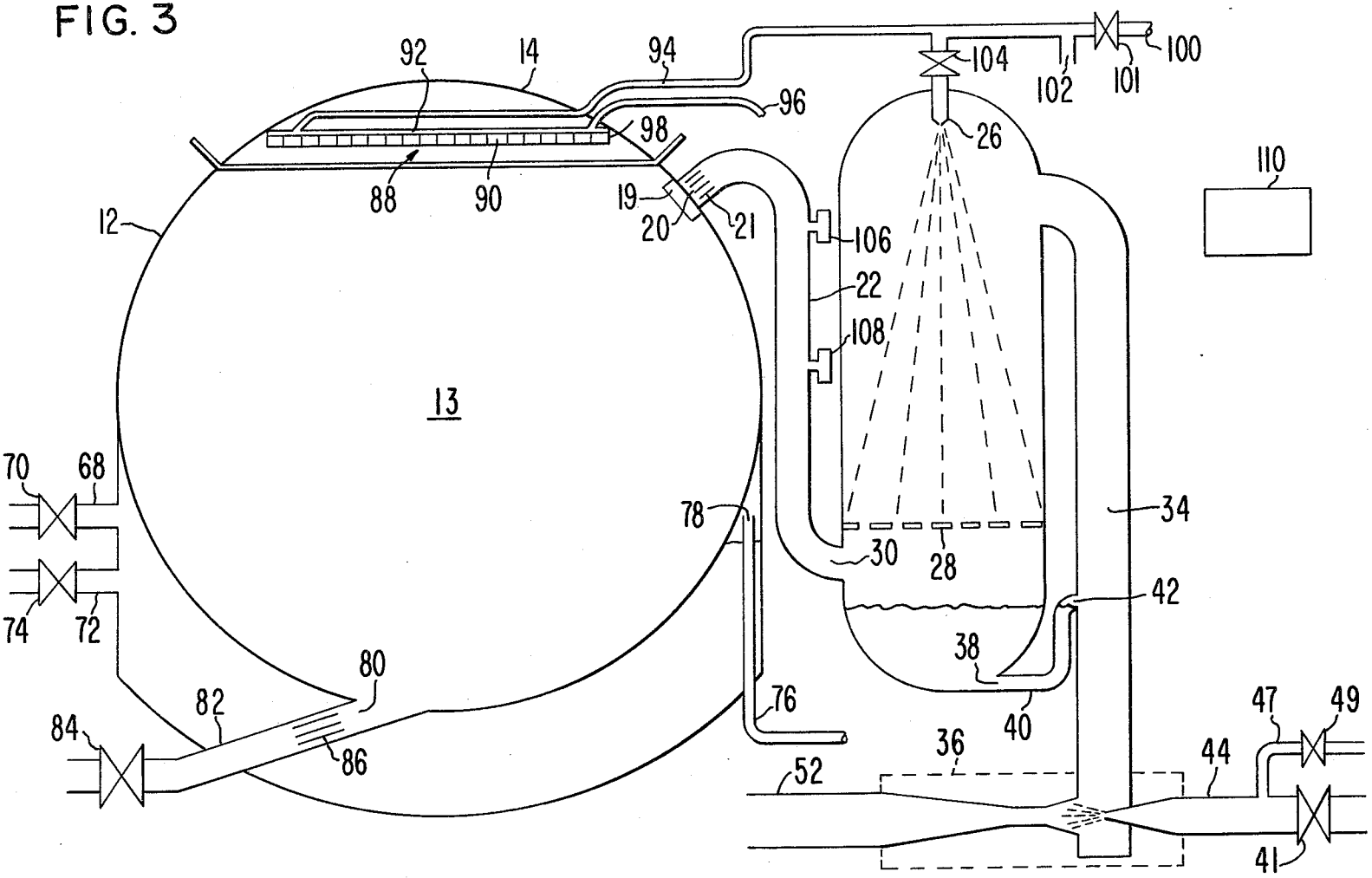
FIG. 3 is a diagramatical view of an alternative embodiment of the subject invention when the water pump and water reservoir are removed.

FIG. 3 is a diagramatical view of the invention without the water pump and the water reservoir. The water inlet line 44 to water jet exhauster is attached directly to the cold water line through a shut off valve 41. The water exhaust line 52 from the water jet exhauster now goes directly to the drain. After the initial pump down to a pressure of 1.5 in. Hg absolute, the standby water valve 49 is opened and the main water valve 41 is closed. The standby flow rate is perhaps one-quarter that of the full flow, but is adequate to maintain the pressure at 1.5 in. Hg after it has been obtained. The water consumption with this simplified version is approximately five times as great as the preferred embodiment of the present invention described with respect to FIG. 1. Drying time is approximately the same.

Figure 4:
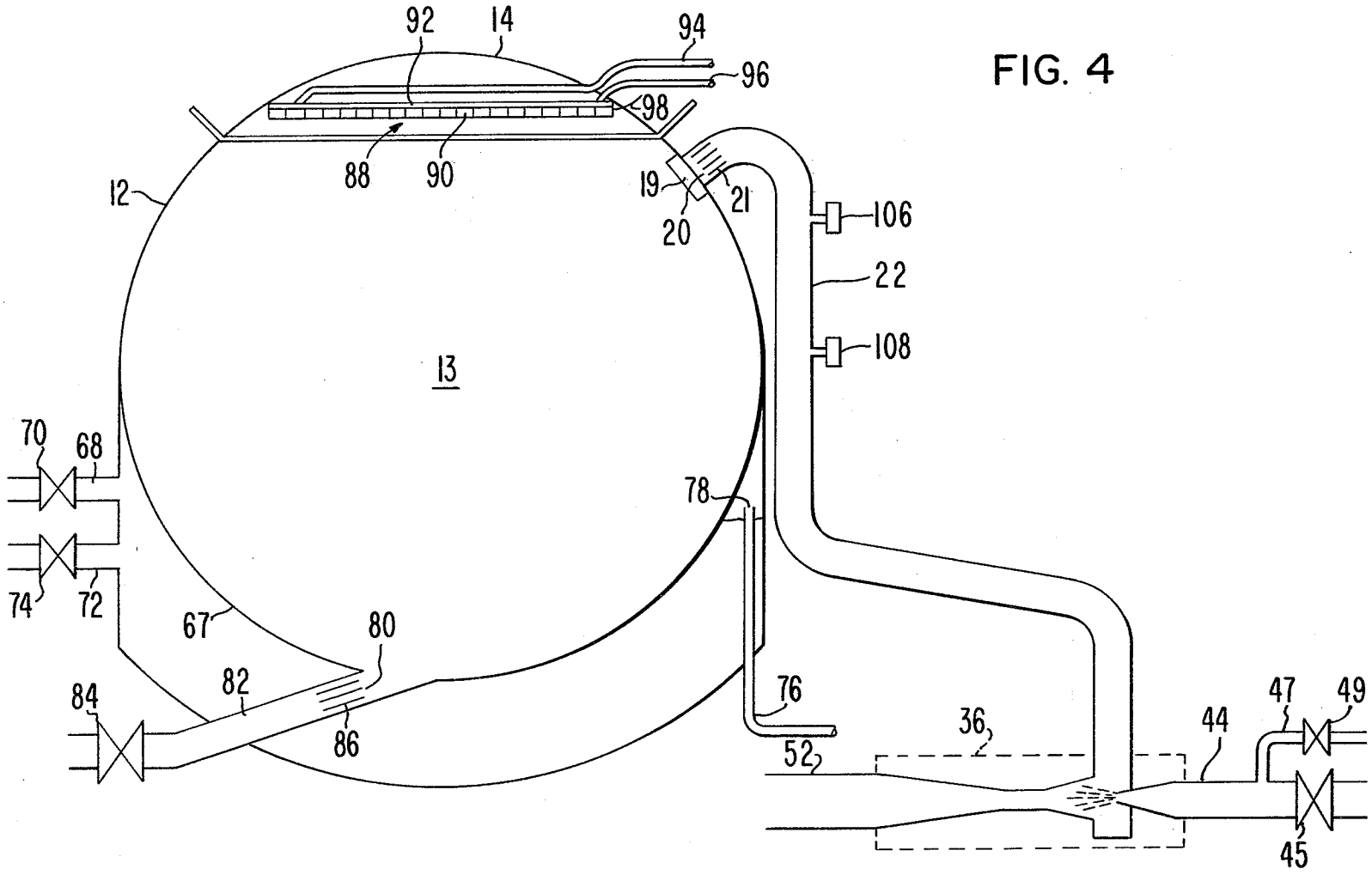
FIG. 4 is a diagramatical view of a second alternative embodiment of the subject invention where the water pump, water reservoir and spray condenser are removed.

FIG. 4 is a diagramatical view of still another alternative embodiment of the subject invention which is a further simplification over the first alternative embodiment. In this FIG. 4 embodiment the spray condenser has been eliminated and all the condensation of vapor occurs in the water jet exhauster 36. Elimination of the spray condenser alone may also be practiced with the preferred embodiment of the invention. In the FIG. 4 embodiment the rate of vapor condensation will be reduced because the vacuum exhauster has limited surface area for vapor contact. Drying times will be increased as will water consumption over the original invention. A less powerful solid state microwave array 88 is selected to match the vapor condensation rate of the water jet exhauster 36.

Figure 5:
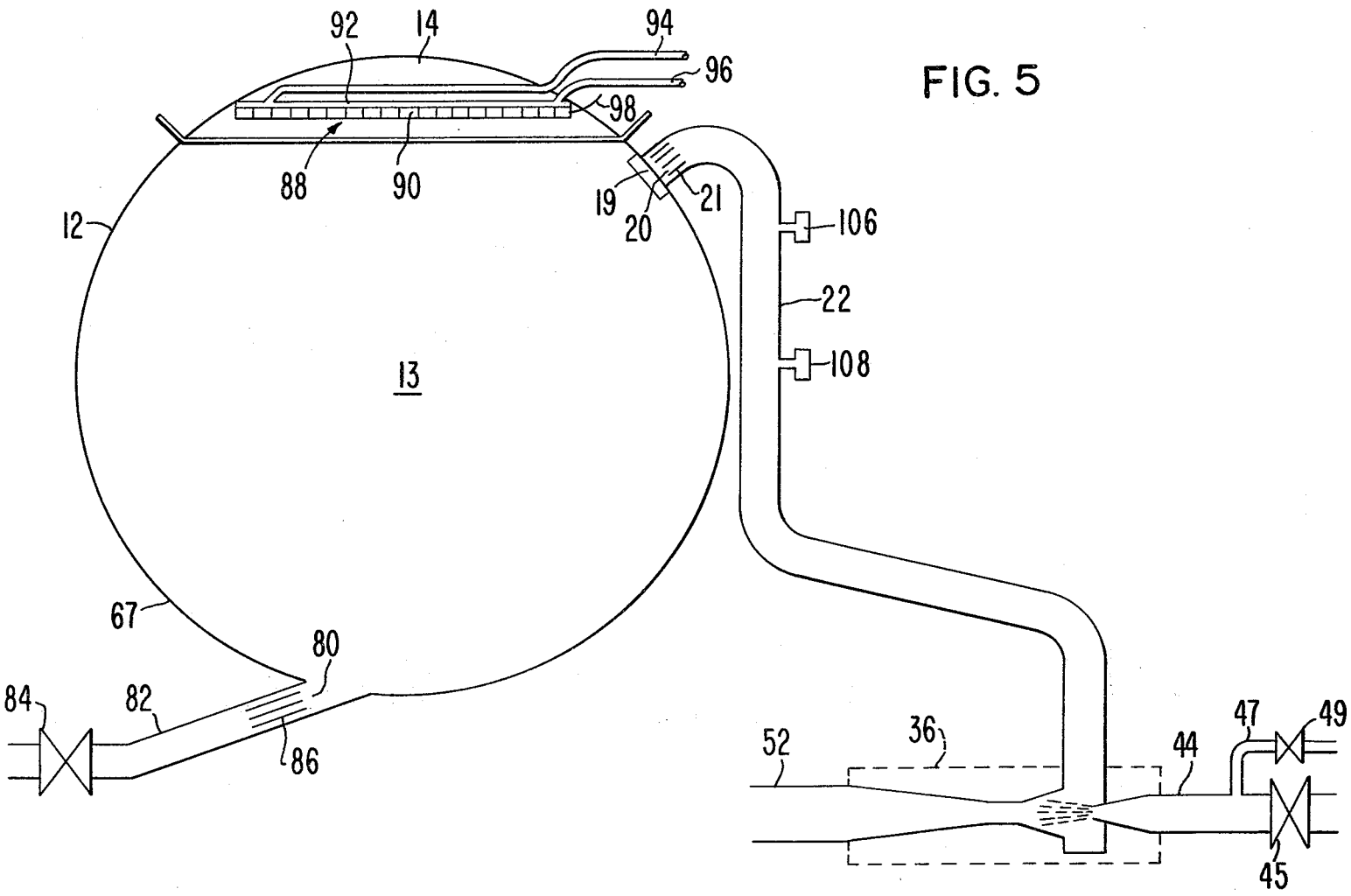
FIG. 5 is a diagramatical view of a third alternative embodiment of the subject invention where the water pump, water reservoir, spray chamber and water jacket chamber are removed.

FIG. 5 is a diagramatical view of yet another alternative embodiment of the present invention representing a further simplification in design. Here the water jacket chamber 66 has been eliminated from the design. This omission can apply to the preferred embodiment or any of the other alternative embodiments. In the preferred embodiment the heat from the water jacket chamber contributed approximately 15% of the heat to dry the fabric. Hence, if the water jacket chamber is eliminated, the drying time would increase. This heat could, however, be supplied by increasing the size of the solid state microwave array 88.

Subscale Tests

To obtain design data for the microwave fabric dryer a series of subscale tests were conducted. The tests were subdivided into microwave dryer tests and heat transfer tests.

The apparatus for the microwave dryer tests was composed of a 250 mm plastic vacuum dessicator of polycarbonate material placed inside a Sears Roebuck 1.5 kW microwave oven operating at a frequency of 2450 MHz using a magnetron tube to generate the microwave energy. A one-half inch aluminum vacuum line 24 inches in length was connected to the dessicator and led from the inside of the oven to the outside of the oven through a hole in the oven wall.

A spray condenser was constructed of PVC pipe couplings and end caps measuring 4½ inches in inside diameter and with a height of 12 inches. The vacuum line from the dessicator was connected into the side of the spray condenser 4 inches from the bottom. Immediately above the inlet an aluminum distributor plate with 1/32 inch holes on ⅛ centers was mounted. A ⅛ inch spray nozzle with a solid 30° spray cone was mounted at the top of the spray chamber; the flow rate of the nozzle was 0.36 gpm with a pressure differential of 30 psia.

A second ½ inch vacuum line led from the upper surface of the spray condenser to a laboratory type water jet exhauster. Cold water from a household outlet was used to power the water jet exhauster. The spent water was directed to the drains. Water collecting in the bottom of the spray condenser was piped to an evacuated reservoir 3.75 in. in diameter and 18 feet long located at a level below the spray condenser. Calibrated bourdon vacuum gauges were used to measure the system pressure.

The wet fabric was weighed and placed in the dessicator which was located inside the oven. The water jet exhauster was activated and allowed to run until an absolute pressure of 1.5 in. Hg was achieved in the system. The spray condenser was subsequently activated, and the microwave oven turned on. The oven was operated for a specific time. At the termination of the test run the vacuum was broken, the specimens were removed from the dessicator and were weighed. The overall efficiency of the microwave heating was subsequently calculated. The energy input was measured as the power into the oven for the duration of the test. The useful energy was measured as the loss of water times the heat of vaporization at 92° F.

Cloth loads ranging from 7 ounces to 37 ounces of wet weight were tested. Cloth for testing was usually taken directly from a washer after washing; moisture content of the specimens ranged from 55% to 25%. Fabrics made from cotton, synthetics, wool, Indian madras and a rubberized material (Spandex) were tested. Tests ran from 6 to 12 minutes after a pressure of 1.5 in. Hg had been establlished in the system.

The overall efficiency of the microwave drying cycle was approximately 40–45%. In a typical test a 14.2 oz. dry cotton cloth specimen was dried from 36% moisture to 8% moisture in 12 minutes at a pressure of 1.5 in. Hg. Microwave efficiency was 40% for this test.

The specimens were only slightly warm to the touch after drying. The dimensions of wool specimens were measured before and after testing. No shrinkage could be measured. Buttons and zippers appeared unaffected by the process.

The Sears Roebuck microwave oven used for the experiments used a magnetron tube for microwave generation. In general, magnetrons in microwave ovens are only 50% efficient in converting input power to microwave power. In addition, the oven contained a browning plate which absorbed microwave energy. Consequently, the low efficiencies obtained in the experiments compared to the solid state microwave power devices of the subject invention are explainable.

The objective of the heat transfer test was to measure the surface heat transfer coefficient between a warm surface and wet fabric in a partial vacuum where the temperature of the surface was in excess of the vaporization temperature in the partial vacuum. A 44 square inch copper plate with a copper tube brazed to its lower surface was mounted horizontally within a 250 mm vacuum dessicator. Hot water connections and drain connections were made through the wall of the dessicator. A ½ inch vacuum line was attached to the dessicator and connected to the spray condenser of the vacuum system previously described.

Eight layers of wet cotton cloth were placed over the 44 square inch surface covering it. The dessicator was closed and the pressure reduced to 1.5 in. Hg absolute. Hot water at 140° F. was allowed to flow through the coil at a high flow rate for five minutes. The vacuum was broken, the specimen was removed and the specimen was weighed. As expected, the measured heat transfer coefficient varied directly with the moisture content of the fabric. The results were as follows:

| Moisture Content of Cotton Fabric % | Heat Transfer Coefficient BTU/Ft$^2$-°F.-HR |
|---|---|
| 50% to 36% | 111 |
| 36% to 25% | 68 |
| 25% to nil | nil |

During all of the experiments the apparatus was routinely operated at a pressure of 1.5 in. Hg using the small laboratory type water jet exhauster operating with 60° F. water.

EXAMPLES

While the invention is believed to have been described above in sufficient detail for one skilled in the art to construct a microwave fabric dryer, an example of a typical microwave fabric dryer operating as a home clothes dryer is given. The microwave dryer will take a normal 15 pound load of wet clothes and dry them in 11 minutes. It requires 12 kW of electric power at 220 volts AC single phase, approximately the same as an electric stove. To dry a normal load of clothes it requires 1.8 kWh of electric power, 32 gallons of cold water and 4 gallons of hot water. It is the same size as a conventional dryer and slightly heavier. The overall efficiency is 72%. It is capable of drying wool and other heat sensitive fabrics without shrinking. It is top loading for convenience and it has a cool wall feature to prevent creasing of permanent press clothes.

The drying chamber is a sphere 1.6 feet in diameter with a wall thickness of 1/16 inch; the volumetric capacity is 2 cubic feet. The sphere is spun from mild steel and has a theoretical crushing pressure of 1500 pounds, ten times atmospheric pressure. It weighs 225 pounds. The spray condenser is a cyllndrical plastic vessel with an internal diameter of 5.5 inches and a height of 16 inches. The flow rate of cold water to the spray nozzle is 2.7 gal/min. A commercial 1½ inch water jet exhauster is used, driven by a 30 gallon per minute 80 psi water pump powered by a 2 hp electric motor. A 20 gallon water reserve is employed. Extensive use of plastic is made for all components except the drying chamber.

The solid state microwave array has a power input of 10 kW with a 90% efficiency. It is manufactured as an assembly along with its special controls and mounted on the door of the dryer. Interlocks, similar to those used with microwave ovens, are used to prevent activation of the microwave array unless the store is closed and locked. Safety will be improved over the microwave ovens because the microwave generator is contained entirely within the steel enclosure.

Aside from the home clothes dryer, many other applications are possible. Small apartment dryers that would quickly dry a few clothes or larger units for the basement of an apartment building that are shared by many would both benefit from the advantages of the microwave fabric dryer. Commercial units that would be used by clothes cleaners to replace the dry cleaning processes that use hydrocarbons and pollute the atmosphere are yet another application.

Other aspects, objects and advantages of this invention can be obtained from a study of the drawings, the disclosure and the appended claims.

What is claimed is:

1. A microwave fabric dryer comprising:

means defining a microwave reflective drying chamber for accommodating fabrics to be dried, means defining a vacuum chamber which includes said drying chamber within its boundaries, microwave energy generating means including at least a solid state microwave device for production of microwave energy at a predetermined frequency, means for directing the microwave energy into the drying chamber, condensing means external to the drying chamber but in fluid communication therewith for condensing water vapor evolved from the drying fabric, air pumping means external to the vacuum chamber for reducing the pressure within the vacuum chamber to a pressure below the vapor pressure of the water during the drying process, and control means for terminating the microwave power when fabrics have reached the predetermined degree of dryness.

2. The dryer of claim 1 wherein the means for directing the microwave energy into the drying chamber includes means for mounting said solid state microwave device within said drying chamber.

3. The dryer of claim 1 wherein said condensing means external to the drying chamber includes a water spray condenser.

4. The dryer of claim 1 wherein the condensing means external to the drying chamber includes a water jet exhauster also used to provide said air pumping means.

5. The dryer of claim 1 wherein said condensing means external to the drying chamber is a water spray condenser in combination with a water jet exhauster, said exhauster used to provide said air pumping means.

6. The dryer of claim 1 wherein said air pumping means includes a water jet exhauster.

7. The dryer of claim 1 wherein said air pumping means includes a water jet exhauster, a water pump and a water reservoir with the inlet to the pump connected to said reservoir, the outlet from said pump connected to the inlet of said exhauster and the outlet of said exhauster connected to said reservoir to cause a circulating flow of water.

8. The dryer of claim 1 wherein said air pumping means includes a mechanical vacuum pump.

9. The dryer of claim 3 including a water jet exhauster connected to said spray condenser wherein the warmed water from the spray condenser is pumped from partial vacuum conditions to atmospheric pressure by said water jet exhauster.

10. The dryer of claim 5 including water drain means for removing water from said condenser and means connecting the water drain means from spray condenser to said exhauster whereby the warmed water from the spray condenser is pumped from partial vacuum conditions to atmospheric pressure by the water jet exhauster.

11. The dryer of claim 1 wherein said microwave reflective drying chamber is constructed of mild steel with a corrosion resistant coating.

12. The dryer of claim 1 wherein said microwave generating means includes an array of solid state microwave devices for production of microwave energy at a predetermined frequency.

13. The dryer of claim 1 wherein said control means for terminating the drying cycle includes means for sensing a change in electrical current flow within the solid state microwave device as the amount of water vapor in the drying chamber approaches small values.

14. The dryer of claim 1 wherein said air pumping means reduces the pressure level in the vacuum chamber at least to 2.5 inches of mercury absolute during the vaporization portion of the drying cycle.

15. The dryer of claim 1 wherein said solid state microwave device has a microwave power input of at least 5 kW.

16. A microwave fabric dryer comprising:

means defining a microwave internally reflective drying chamber for accommodating the fabrics to be dried, means defining a vacuum chamber which includes said drying chamber, microwave energy generating means including a solid state microwave device for production of microwave energy at a predetermined frequency, means for directing the microwave energy into the drying chamber to vaporize water contained in the fabrics to be dried, condensing means external to the drying chamber for condensing water vapor evolved from the drying fabric, air pumping means external to the vacuum chamber for reducing the pressure within the chamber to a pressure below the vapor pressure of the water during the drying process, control means for terminating microwave power from said generating means when fabrics have reached the predetermined state of dryness, heating means for warming a portion of the inner surface of said drying chamber to vaporize additional water and accelerate drying, means for turning the wet fabric inside said drying chamber to expose new wet fabric surface to said warmed drying chamber surface and for fluffing the fabric at the end of drying to shake out wrinkles, and means for cooling said drying chamber surface in contact with the fabric at the end of the drying cycle to help prevent wrinkles in permanent press cloth.

17. The dryer of claim 16 wherein said heating means for warming a portion of said drying chamber and said cooling means to prevent wrinkles includes a water jacket surrounding at least a portion of said drying chamber surface and means providing hot and cold water communication within said water jacket.

18. The dryer of claim 16 wherein the means for turning the fabric inside of the drying chamber and fluffing the fabric after the drying cycle includes an intermittent air jet in communication with the atmosphere.

19. A method for drying fabric quickly and at a low temperature comprising the steps of:

reducing the atmospheric pressure in and around the wet fabric to a pressure below the vapor pressure of the water during the drying process, subjecting the wet fabric under reduced atmospheric pressure to microwave energy so as to convert the liquid water in the fabric to water vapor which leaves the fabric and enters the atmosphere of reduced pressure, and condensing the water vapor while the water vapor is in the atmosphere of reduced pressure.

20. The method of claim 19 wherein said pressure reducing step includes reducing the pressure to at least 2.5 inches of mercury absolute.

21. The method of claim 20 wherein said microwave energy is directed from a solid state microwave array across the wet fabric.

22. The method of claim 19 wherein said condensing step includes bringing the vapor in direct contact with a cooler spray of water.

23. The method of claim 19 wherein said pressure reducing step includes pumping a water jet through a portion of a reducing chamber and wherein said condensing step includes bringing the vapor in direct contact with the water jet.

24. The method of claim 19 wherein said pressure reducing step includes pumping a water jet through a portion of a reducing chamber and wherein said condensing step includes bringing the vapor in direct contact with both a cooler spray of water and the water jet.

25. A method for drying fabric quickly and at a low temperature comprising the steps of:

reducing the atmospheric pressure in and around the wet fabric, subjecting the wet fabric under reduced atmospheric pressure to microwave energy so as to convert the liquid water in the fabric to water vapor which leaves the fabric and enters the atmosphere of reduced pressure, condensing the water vapor while the water vapor is in the atmosphere of reduced pressure, and conducting heat to parts of the wet fabric in the reduced atmosphere to convert the water therein to vapor which leaves the fabric and enters the atmosphere of reduced pressure.

* * * * *